US009830892B1

(12) United States Patent
Duff

(10) Patent No.: US 9,830,892 B1
(45) Date of Patent: Nov. 28, 2017

(54) FROG FOR BOW FOR STRINGED MUSICAL INSTRUMENT

(71) Applicant: Michael Duff, Bloomington, IN (US)

(72) Inventor: Michael Duff, Bloomington, IN (US)

( * ) Notice: Subject to any disclaimer, the term of this patent is extended or adjusted under 35 U.S.C. 154(b) by 0 days.

(21) Appl. No.: 15/466,039

(22) Filed: Mar. 22, 2017

(51) Int. Cl.
*G10D 3/16* (2006.01)
*G10D 1/00* (2006.01)

(52) U.S. Cl.
CPC ..... *G10D 3/16* (2013.01); *G10D 1/005* (2013.01)

(58) Field of Classification Search
CPC ..... G10D 3/16
See application file for complete search history.

(56) References Cited

U.S. PATENT DOCUMENTS

| | | | | |
|---|---|---|---|---|
| 676,028 | A | 6/1901 | Conklin | |
| 2,003,131 | A | 5/1935 | Turner | |
| 2,780,953 | A | 2/1957 | Gardner | |
| 3,815,155 | A | 6/1974 | Iverson et al. | |
| 3,919,912 | A | 11/1975 | Darling | |
| 4,020,731 | A * | 5/1977 | Darling | G10D 3/16 411/957 |
| 6,569,540 | B1 | 5/2003 | Preston et al. | |
| 6,906,138 | B2 | 6/2005 | Quinn | |
| 7,482,518 | B1 | 1/2009 | DiSanto | |
| 8,555,521 | B2 | 10/2013 | Bies et al. | |
| 2006/0272478 | A1 | 12/2006 | Steinhour et al. | |
| 2015/0243265 | A1 | 8/2015 | Laukat et al. | |
| 2015/0310839 | A1 * | 10/2015 | Snyder | G10D 3/163 84/322 |

FOREIGN PATENT DOCUMENTS

| | | | | |
|---|---|---|---|---|
| WO | WO 9303896 A1 * | 3/1993 | ..... | B27K 3/15 |

* cited by examiner

*Primary Examiner* — Kimberly Lockett
(74) *Attorney, Agent, or Firm* — Woodard, Emhardt, Moriarty, McNett & Henry LLP

(57) ABSTRACT

A frog, and a bow with a frog, for stringed musical instruments is disclosed. The frog is made with a body from stabilized wood. The speed of sound through the frog body is enhanced resulting in more beautiful music.

11 Claims, 1 Drawing Sheet

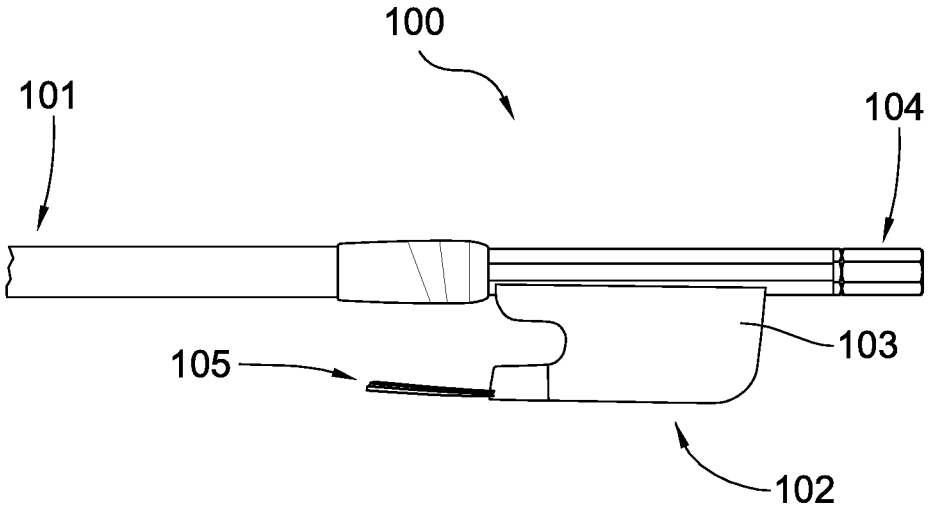
100
101
104
103
105
102

FROG FOR BOW FOR STRINGED MUSICAL INSTRUMENT

FIELD OF INVENTION

The present invention is in the field of bows and frogs for bows for stringed musical instruments.

BACKGROUND

Stringed musical instruments, such as for example the violin, viola, cellos and stringed bass, that use bows to create music are popular and classically timeless. They are the subject of artistry in both construction and use. The construction and properties of their materials, including woods and otherwise, are the subject of study. The acoustics are complex and largely unpredictable. With respect to bows, various shapes, materials, profiles and construction techniques are the subject of attempts to enhance the beauty of the music from the instrument made with the bow and to enhance the predictability of use to and control by the musician.

The present invention is a non-obvious breakthrough in the construction of the bow, and in particular the frog of a bow.

Thus, there is a need for improvement in this field.

SUMMARY

The claims, and only the claims, define the invention. The invention may be summarized as a frog for a stringed musical instrument bow. The frog has a main body portion. The main body portion being adapted to attach to an adjuster for adjusting bow hair tension. The frog main body portion comprises wood, which wood is stabilized, and in its stabilized form, transmits sound through it at a speed at least about ten percent faster than the speed of sound transmits through such wood without stabilization.

Further forms, objects, features, aspects, benefits, advantages, and embodiments of the present invention will become apparent from a detailed description and drawings provided herewith.

BRIEF DESCRIPTION OF THE DRAWINGS

FIG. 1 is a side elevation view of a portion of a bow including the present invention.

DESCRIPTION OF THE SELECTED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Referring to the examples shown in the drawings (FIG. 1) shows an example frog 102 for a stringed musical instrument bow 100 (showed only partially, cut away), comprising a main body portion 103. The bow 100 includes a stick 101; and the stick may optionally be made from any bow stick material such as wood (for example Pernambuco, as is known, or otherwise), from carbon fiber, from polymer, monomer or other synthetic material, or hybrids or combinations thereof. The stick optionally may be made from stabilized wood. The main body portion 103 may be adapted to attach (directly or indirectly) to an adjuster 104 for adjusting bow hair 105 (shown partially cut away) tension. Note as used herein, "hair" means and includes mammal hair (for example horse tail hair) as well as other materials (synthetic (e.g. ZARELON®) or otherwise) and combinations thereof.

The speed of sound through a material, such as through stabilized wood, as measured herein may be measured using a Lucchi Meter (Cremona, Italy (a city having a distinguished musical history)) at about room temperature (about 20 degrees Celsius).

The frog main body portion 103 comprises wood, which wood is stabilized and, in its stabilized form, transmits sound through it preferably at a speed at least about ten percent faster than the speed of sound transmits through such wood without stabilization. Stabilization of wood, in general is known, and any such stabilization is believed to be acceptable. Preferably, this may include a standardized mix of polymers and monomers, employed in a series of precisely measured sub-process work steps. The objective of the aggregate process is to infuse work-in-process wooden blocks with resins, resulting in media take-up to centerline core of individual pieces. The finished item result is a hybrid material that is neither wood nor plastic, but rather, an amalgamation of both. The resulting increase in density of natural tropical hardwood raw material, produces an empirically measurable increased velocity of sounds, as well as an audibly detectable improvement in the quality of sound delivered from each/all of the world's best tonewoods. Optionally, it is theorized here that the speed of sound through the wood by stabilizing repeatedly (two or more times).

Optionally, when woods are used for frog body 103, they may include the following species although others are believed to be possible, but not quite as optimal:

| Common Name | Regional Name | Botanical (Latin) |
|---|---|---|
| African Blackwood | Mpingo | *Dalbergia melanoxylon* |
| Honduran Rosewood | Rozul | *Dalbergia stevensonii* |
| Ebony | (Various varieties) | *Diospyros* spp. |
| Cocobolo | Nicaraguan Rosewood, Palo Negro | *Dabergia retusa* |
| Pernambuco | Brazilwood | *Caesalpinia echinata* |
| Snakewood | Amouretts | *Piratinera guianensis* |
| Lignum vitae | Guayacan | *Guaiacum officinale* |
| Desert Ironwood | Sonora Ironwood | *Olneya tesota* |
| Ziricote | N/A (No other Common Name) | *Cordia dodecandra* |
| Hormigo | Palo de Marimba | *Platymiscium dimorphandrum* |
| Cortez Ipe' | Lapacho, Guayacan | *Tabebuia chrysantha* |
| Bocaté | Laurel, Salmwood | *Cordia alliodora* |
| Chechen | Black Poisonwood | *Metopium brownie* |

Of those, based on current evaluation it is believed that woods such as African Blackwood, Rosewood, and Ebony are preferred. And of those, based on current evaluation it is believed that African Blackwood is, or at least may be, most preferred.

The frog main body portion 103 optionally may include the feature where said wood, in its stabilized form, transmits sound through it at a speed of at least 4,300 meters per second, more preferably of at least 4,500 meters per second, and optionally at least 5,000 meters per second and potentially even higher (thirty percent, forty percent or more).

The frog main body portion 103 optionally may include the feature where said wood, in its stabilized form, transmits sound through it at a speed between about ten and twenty-five percent faster, than the speed of sound transmits through such frog body wood without stabilization.

The frog main body portion 103 optionally may include the feature where said wood has woodgrains, and said woodgrains are generally parallel to a bow stick 101. This feature standing alone, without stabilization, is known.

Optionally, other components of bow 100 may be made of stabilized wood(s) of the type (and sound speed characteristics) discussed herein regarding frogs and the frog body. For example, instead of or in addition to the frog being made from stabilized wood, the stick 101 and/or the tip (not illustrated) at the tip of the stick may be made from stabilized wood. Thus, as one example, the tip, stick 101 and frog 102/103 may be made from stabilized wood. And, for another example, the stick 101 may be made of stabilized wood, even if the frog is not.

Without being bound to theory, I believe that the bow (including the stick, hairs and frog) form a sound loop around which sound travels as the musical instrument is being played. It is believed that optimizing the speed of sound around such loop (in one or both directions) enhances the music quality produced. The reasons are mysterious and unknown to me, but may include resonance and/or constructive or destructive harmonics in and through the loop. It is also believed, (again not being bound to theory), that having the frog (namely the frog body) be made of a material, such as stabilized wood, not be the slow link (or at least not be an excessively slow link) in the loop helps improve the musical sound.

The stringed musical instrument bow 100 optionally may include the feature of where stick 101 transmits sound longitudinally through it at a stick speed. The frog main body portion comprises wood and in its stabilized form, preferably transmits sound through it at a frog speed that is preferably at least about 5,000 meters per second, and wherein said frog speed is within about ten percent, plus or minus, of said stick speed.

Articles and phases such as, "the", "a", "an", "at least one", and "a first", "comprising", "having" and "including" here are not limited to mean only one, but rather are inclusive and open ended to also include, optionally, two or more of such elements and/or other elements. In terms of the meaning of words or terms or phrases herein, literal differences therein are not superfluous and have different meaning, and are not to be synonymous with words or terms or phrases in the same or other claims.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Webster's dictionaries and Random House dictionaries.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A frog body for a stringed musical instrument bow, comprising:

A main body portion of a frog to be attached to a musical instrument bow stick;

said frog main body portion being adapted to attach to an adjuster for adjusting bow hair tension;

Wherein said frog main body portion:

a) Comprises wood;

b) Said wood is stabilized by infusion of wood with material including resin selected from the group consisting of polymer, monomer, and combinations thereof; and, c) Said wood, in its stabilized form, transmits sound through it at a speed at least about ten percent faster than the speed of sound transmits through such wood without stabilization.

2. The frog body of claim 1, wherein said wood, in its stabilized form, transmits sound through it at a speed between about ten and twenty-five percent faster than the speed of sound transmits through such wood without stabilization.

3. The frog body of claim 1 in combination with an adjuster, a stick and bow hairs to form a musical instrument bow.

4. The frog body of claim 1 wherein said wood, in its stabilized form, transmits sound through it at a speed of at least 4,300 meters per second.

5. The frog body of claim 1 wherein said wood, in its stabilized form, transmits sound through it at a speed of at least 5,000 meters per second.

6. The frog body of claim 1, wherein said wood is selected from the group consisting of: African Blackwood, Rosewood, and Ebony.

7. The frog body of claim 1, wherein said wood is selected from the group consisting of: African Blackwood, Rosewood, Ebony, Cocobolo, Pernambuco, Snakewood, Lignum vitae, Desert Ironwood, Ziricote, Hormigo, Cortez Ipe', Bocaté and Chechen.

8. The frog body of claim 1, wherein said wood is African Blackwood.

9. The frog body of claim 1 wherein said wood has woodgrains, and said woodgrains are generally parallel to a bow stick.

10. A frog body for a stringed musical instrument bow, comprising:

A main body portion of a frog to be attached to a musical instrument bow stick;

said frog main body portion being adapted to attach to an adjuster for adjusting bow hair tension;

Wherein said frog main body portion:

a) Comprises wood;

b) Said wood is stabilized by infusion of wood with material including resin selected from the group consisting of polymer, monomer, and combinations thereof; and, c) Said wood, in its stabilized form, transmits sound through it at a speed at least about 4,300 meters per second.

11. The frog body of claim 10, wherein said stick transmits sound longitudinally through it at a stick speed and wherein said frog speed is within about ten percent, plus or minus, of said stick speed.

* * * * *